United States Patent [19]

Wiley et al.

[11] Patent Number: 4,674,656

[45] Date of Patent: Jun. 23, 1987

[54] AGITATOR ASSEMBLY FOR THE REFRIGERATION SYSTEM OF A BEVERAGE DISPENSER

[75] Inventors: Ronald L. Wiley, Marietta, Ga.; Robert C. Iwans, Simsbury, Conn.

[73] Assignee: The Coca-Cola Company, Atlanta, Ga.

[21] Appl. No.: 663,136

[22] Filed: Oct. 22, 1984

Related U.S. Application Data

[60] Division of Ser. No. 663,134, Oct. 22, 1984, abandoned, which is a continuation-in-part of Ser. No. 552,385, Nov. 16, 1983, abandoned.

[51] Int. Cl.[4] ..... B67D 5/56

[52] U.S. Cl. ..... 222/129.1; 222/146.6; 222/325; 62/390; 366/144; 366/251

[58] Field of Search ..... 222/129.1, 129.2, 129.3, 222/129.4, 146.6, 132, 325; 62/390, 389, 392, 393; 366/331, 144, 251; 165/80 R, 80 A, 185

[56] References Cited

U.S. PATENT DOCUMENTS 2,448,927 9/1948 Fischer ..... 366/144 X
2,824,431 2/1958 Pearson ..... 62/392 X
3,215,312 11/1965 Guzzi ..... 222/129.1
4,103,192 7/1978 Wenolt et al. ..... 165/185 X

FOREIGN PATENT DOCUMENTS 0080253 6/1983 European Pat. Off. ..... 222/146.6

*Primary Examiner*—Joseph J. Rolla
*Assistant Examiner*—David H. Bollinger
*Attorney, Agent, or Firm*—Birch, Stewart, Kolasch & Birch

[57] ABSTRACT

A post-mix beverage dispenser apparatus includes a syrup compartment in which a plurality of inverted flavor concentrate containers are plugged into sockets associated with selectively actuatable dispensing nozzles. The containers are also supported by snapping the sidewalls thereof into conformally shaped cooling fins. The fins and containers are properly dimensioned so that a snap-fit results therebetween. The cooling fins are directly attached to a thermally conductive plate which is in direct thermal contact with a water reservoir. Water within the reservoir is chilled by a suitable refrigeration device disposed therein. A carbonator tank is also disposed within the water reservoir. An agitator assembly rests on top of the water reservoir and includes an impeller, a heat sink and a pair of ice detecting probes which extend into the water.

1 Claim, 9 Drawing Figures

AGITATOR ASSEMBLY FOR THE REFRIGERATION SYSTEM OF A BEVERAGE DISPENSER

BACKGROUND OF THE INVENTION

This application is a division of a U.S. application Ser. No. 663,134 filed 10/22/84 now abandoned entitled "Refrigeration System For A Beverage Dispenser" filed on even date herewith by Wolfgang Fischer, Richard T. Kennedy and Ronald L. Wiley, which is a continuation-in-part of U.S. application Ser. No. 552,385, filed Nov. 16, 1983 now abandoned.

The present invention relates to a post-mix beverage dispenser; a syrup container supply system therefor of the gravity flow type; a refrigeration systeml for both the syrup supply system and an associated carbonator; and an improved agitator assembly for the refrigeration system.

Agitator assemblies for circulating water in a refrigerated water bath of a post-mix beverage dispenser are generally known. During periods of heavy use of these dispensers, the electric motors which drive the impellers of these agitators can heat up to potentially damaging levels. Accordingly, a need in the art exists for a means for dissipating this heat to preclude damage to the agitator motor.

Furthermore, a need in the art exists for a unique support structure for an agitator assembly which permits easy removal of the assembly from the beverage dispenser for repairs or maintenance.

SUMMARY OF THE INVENTION

Accordingly, it is a primary object of the present invention to provide a heat dissipation means for the electric motor of an agitator assembly.

It is a further object of the present invention to provide a unique support structure for an agitator assembly.

It is another object of the present invention to provide a support structure for an agitator assembly from which other refrigeration control components, such as ice-detection probes, may be supported.

The objects of the present invention are fulfilled by providing an agitator assembly for circulating the water in a chilled water reservoir of a beverage dispenser, comprising:

(a) a housing for supporting an agitator motor;

(b) support means extending from said housing for engagement with top edges of said water reservoir surrounding said top access opening;

(c) an impeller shaft extending from said motor into the water reservoir;

(d) an impeller on said shaft within the water reservoir; and (e) heat sink means coupling said agitator motor to the water in said water reservoir to dissipate heat in said motor into said water.

The heat sink preferably comprises a metal bracket coupled to the motor having a pair of fingers or arms extending therefrom into said water on opposite sides of the impeller shafts to points adjacent said impeller, preferably contiguous to the refrigerator system evaporator coil.

In addition, a first ice probe means for detecting the formation of ice adjacent to a water coil of the dispenser is mounted on the support means and extends downwardly into the water to positions adjacent the water coil. A second ice probe means for detecting the formation of ice adjacent to the agitator impeller is also mounted on the support means a predetermined distance from the first ice probe means and extends downwardly into said water to positions adjacent said impeller.

These ice probes are connected in a control circuit with the refrigeration compressor to turn the compressor OFF when ice forms next to the water coil or impeller.

BRIEF DESCRIPTION OF THE DRAWINGS

The objects of the present invention and the attendant advantages thereof will become more fully apparent by reference to the drawings wherein.

DETAILED DESCRIPTION OF THE PREFERRED EMBODIMENT

Figure 1:
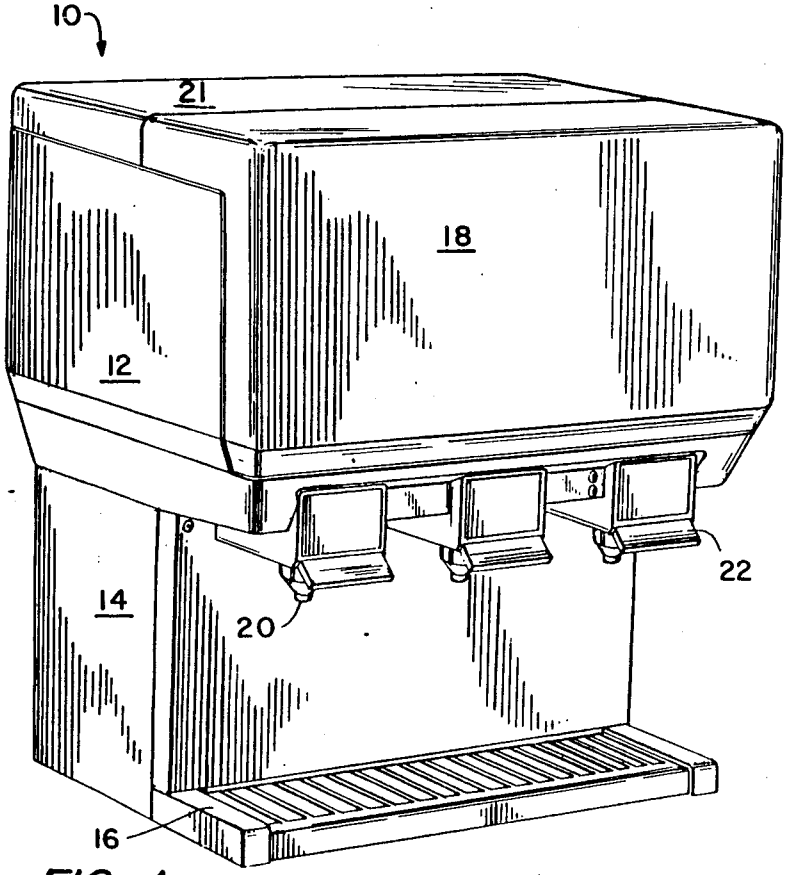
FIG. 1 is a perspective view of the post-mix beverage dispenser of the present invention.

Referring in detail to the drawings, FIG. 1 illustrates a beverage dispenser generally indicated 10, including an upper cabinet portion 12 and a lower pedestal portion 14. The pedestal portion 14 houses the sytem controls, electrical wires, fluid hoses and the mechanical components of the refrigeration system of the present invention. The upper cabinet portion 12 houses a plurality of syrup or flavor concentrate containers in a syrup compartment behind a removable panel 18; and a water reservoir including a carbonator tank underneath a removable panel 21, which will be described in more detail hereinafter with reference to FIGS. 2 and 3. The post-mix beverage dispenser 10 illustrated in FIG. 1 will dispense a beverage of a selected one of three flavors through one of nozzles 20 into a container supported on a drip tray 16 in response to the actuation of a selected one of push buttons 22. As is conventional, flavor concentrate or syrup is mixed with carbonated water in nozzles 20 to form a post-mix beverage.

Figure 2:
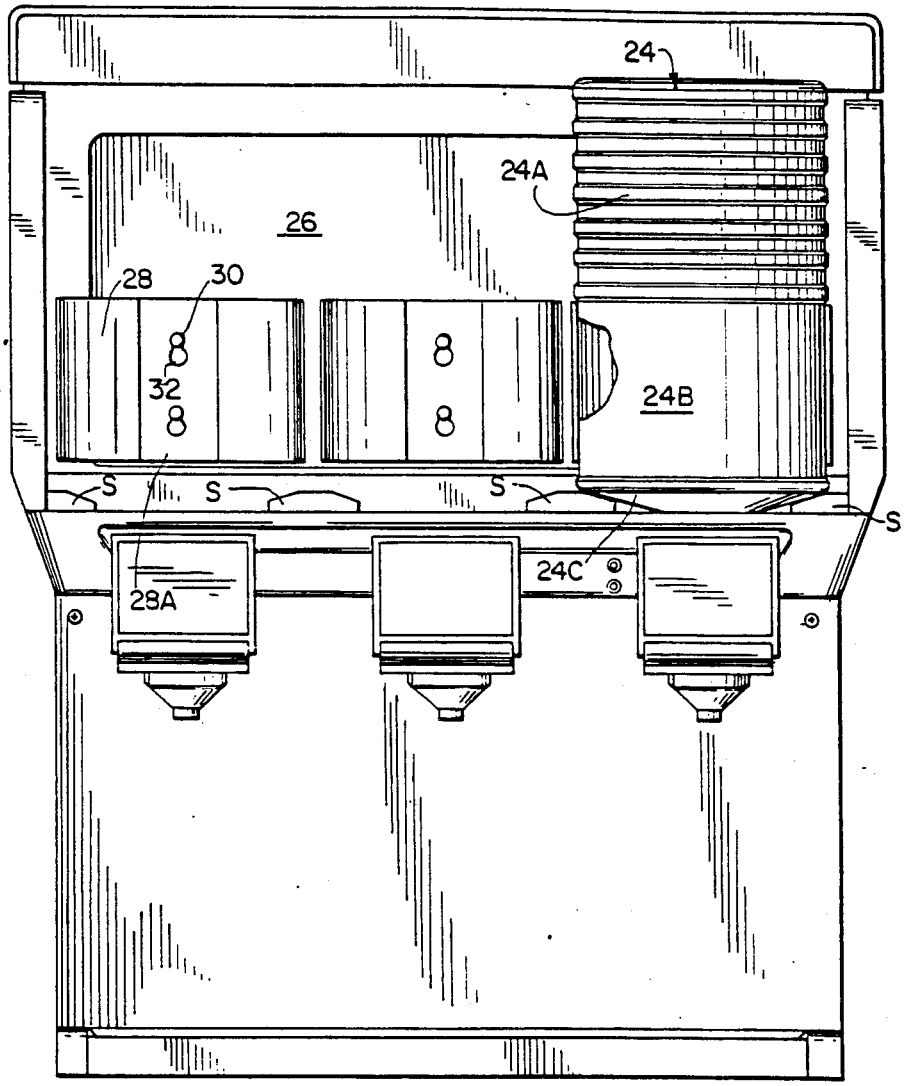
FIG. 2 is a front elevational view of a first embodiment of the dispenser of FIG. 1 with a front cover portion removed to illustrate the syrup compartment.

Referring in detail to FIG. 2, the post-mix beverage dispenser 10 is illustrated with the front cover 18 removed, to show the syrup supply compartment SC of the syrup or flavor concentrate supply system of the present invention. Flavor concentrate, such as syrup, is provided in three inverted syrup containers 24, only one of which is illustrated in FIG. 2. Cylindrical containers 24, also illustrated in FIG. 4, may be of the type disclosed in co-pending U.S. patent applications Ser. Nos. 504,865 and 504,886, filed June 16, 1983, and assigned to the same assignee as the present invention. These containers include a flow rate control tube therein which vents through the bottom of container 24 (the top of the container as viewed in FIG. 2) and a rupturable membrane over the mouth of the container in neck portion 24D. The neck 24D is at the bottom of the container illustrated in FIG. 2. The rupturable membrane is punctured by a piercing device disposed in the central portion of each of sockets 34 (FIG. 3) which are connected to nozzles 20 by means of a suitable valving mechanism (not shown), which is actuatable by push levers 22. The valving mechanism and piercing device may be those disclosed in prior U.S. Pat. No. 4,306,667 to Sedam, et al., assigned to the same assignee as the present invention.

Figure 4:
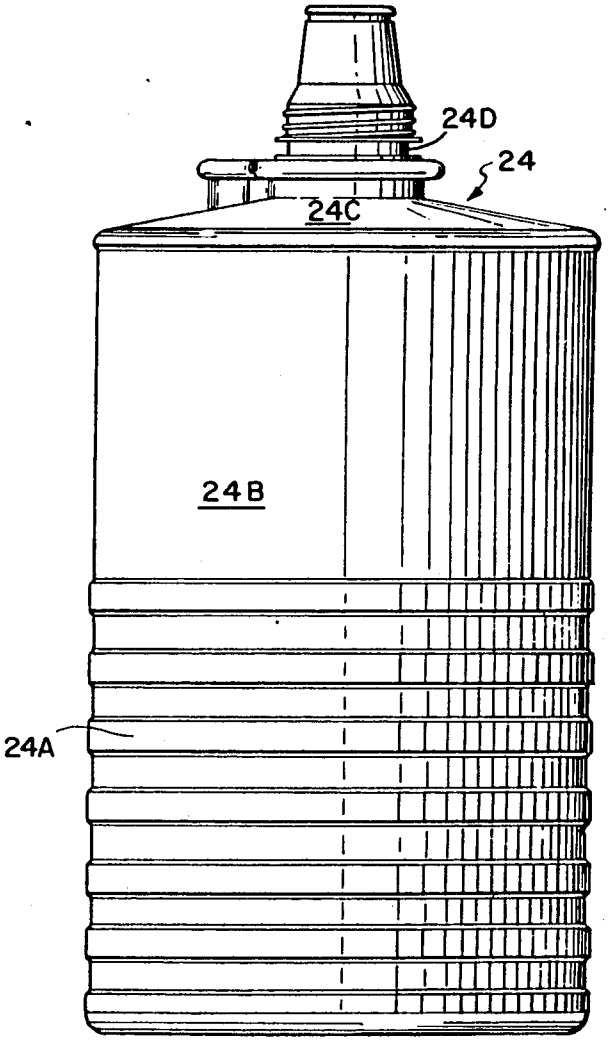
FIG. 4 is an elevational view of an exemplary syrup or flavor concentrate container to be inserted into the dispenser of the present invention, as illustrated in FIG. 2.

Syrup containers 24 of FIG. 4 are inserted into the post-mix beverage dispenser 10 by inverting them and plugging the neck 24D thereof into the respective sockets 34 associated with the respective dispensing nozzles 20. The container 24 of FIG. 4 is shown with a closure therein which must be removed before plugging the neck into the socket.

Figure 3:
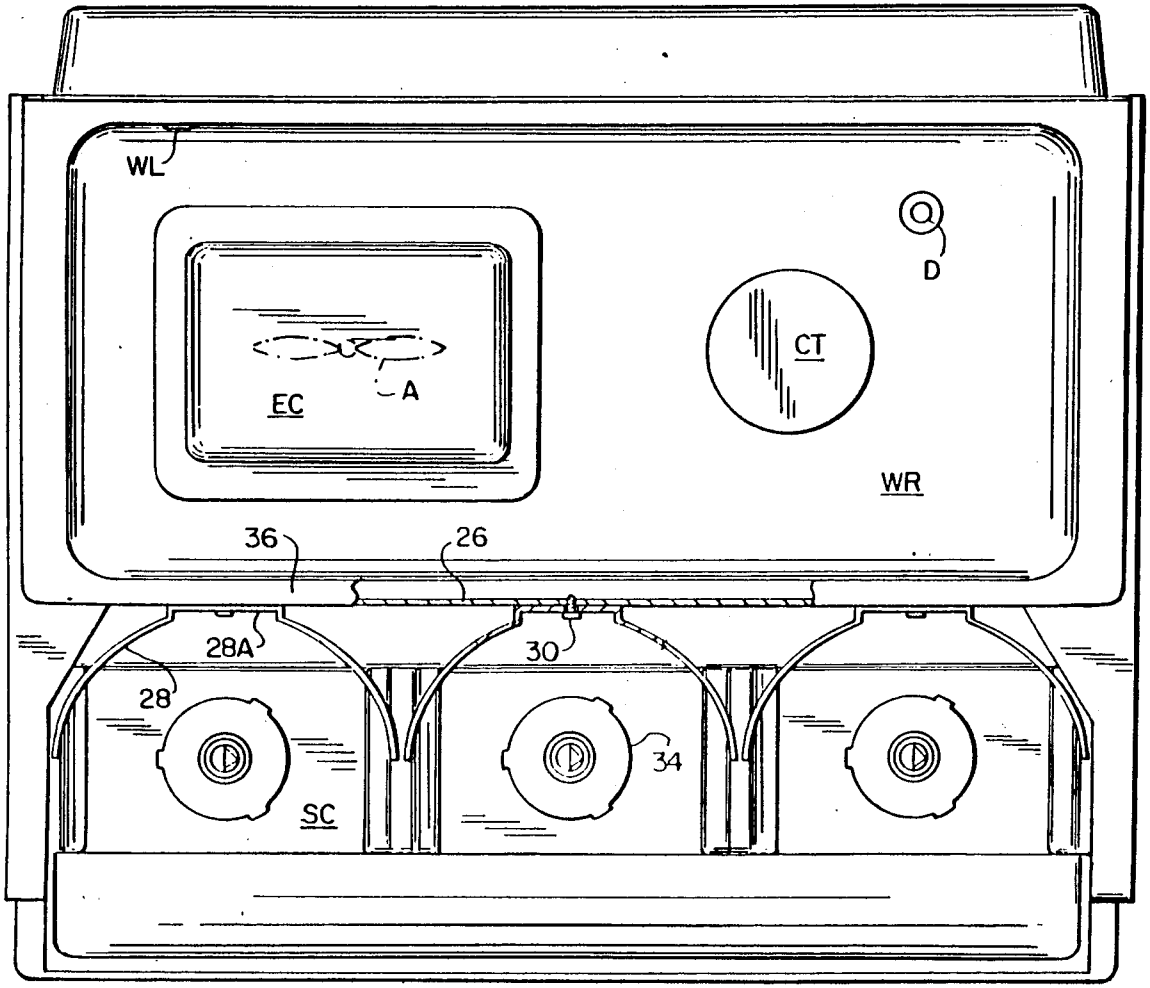
FIG. 3 is a top plan view of the dispenser of FIG. 2 with a top and front cover removed, and a portion broken away and sectioned.

In order to firmly support the syrup containers 24, a cooling fin 28 associated with each of the containers is configured to conform to the circular contour of reduced diameter section 24B of container 24, disposed adjacent the ribbed portion 24A. As illustrated in FIG. 3, cooling fins 28 are generally semicircular in cross-section, but preferably scribe a circular arc in excess of 180 degrees, so that the ends must be flexed outwardly to receive external surface of section 24B of containers 24. Therefore, containers 24 may be snapped into the substantially U-shaped channels formed by cooling fins 28, providing good thermal contact therewith and enabling fins 28 to firmly support the containers 24 in their respective sockets 34.

Additional support for containers 24 is provided by upstanding support surfaces S provided on opposite sides of sockets 34. As illustrated in FIG. 2, these supports S have upper angular surfaces which are complementary to the angle of the surface 24C on container 24.

As further illustrated in FIG. 2, the cooling fins 28 are removably connected to a cooling plate 26 by means of a pair of keyhole slots 32 which fit over the head of a pin 30, extending from plate 26. Therefore, cooling fins 28 are easily removable for cleaning and replaceable for repair, but are connected to cooling plate 26 by means providing a good heat transfer coupling therebetween. Cooling fins 28 are provided with a central offset 28A so that the heads of pins 30 are recessed therein. This precludes interference between the heads of pins 30 and the surfaces 24B of containers 24.

Referring in more detail to FIG. 3, the heat transfer relationship between cooling fins 28 and the refrigeration system components of the present invention are illustrated. FIG. 3 is a top plan view of the post-mix beverage dispenser of FIG. 1 with both the front cover 18 and top cover 21 removed to illustrate the arrangement of the components in the syrup compartment SC, and the water reservoir WR of the present invention. Water is supplied to the water reservoir WR through a water line WL, which is in turn connected to a commercial water supply, such as city water service. The water reservoir WR is dimensioned so that it extends along substantially the entire back wall of the syrup compartment housing the syrup containers 24. In direct contact and substantially coextensive with the front wall 36 of the water reservoir WR (as shown by the broken away section), is a cooling plate 26 formed of stainless steel or any other suitable thermally conductive material. Therefore, the cool temperature of the water in water reservoir WR is transferred through the front wall 36 thereof to the cooling plate 26 in the syrup compartment. This cool temperature, in turn, is transferred to the cooling fins 28 and the containers 24 which are snap-fit therein. Cooling fins 28 may be stainless steel, aluminum or any other suitable material.

Water in the water reservoir WR is chilled by an evaporator coil EC, which is part of a conventional refrigeration system, including a compressor and condensor disposed within pedestal portion 14 of the dispenser 10. Accordingly, the evaporator coil EC within the water reservoir WR cools the water down to a desired temperature selected by appropriate controls in the refrigeration system disposed within pedestal section 14.

To take further advantage of the cooling effect of the water in the water reservoir WR, a carbonator tank CT is also disposed in the water reservoir. Carbonator tank CT is inverted so that all the fittings thereto, such as the $CO_2$ input line, water input line, and carbonated water output line to nozzles 20, connect through the bottom of the water reservoir WR to appropriate conduits or valves in the pedestal section 14.

The water reservoir WR is also provided with a drain D and suitable electrical water level controls to prevent overflow and to control the volume of water therein. Water reservoir WR may be injection molded from plastic to make it inexpensive and light-weight. The same is true of the support tray in syrup compartment SC in which sockets 34 are disposed. Supports S are preferably integrally molded with the tray.

An agitator A is provided for circulating water in reservoir WR to provide continuous flow of water across the wall 36 of reservoir WR. This helps maintain a substantially constant temperature of plate 26 and cooling fins 28. The agitator A and a suitable drive motor therefor may be supported on the underside of cover 20. Therefore, with the cover in place, the agitator extends into the reservoir WR.

DESCRIPTION OF OPERATION

To prepare the post-mix beverage dispenser 10 for operation, syrup containers 24 with appropriate flavor concentrates therein are loaded into the syrup compartment SC by inserting the necks 24D thereof into sockets 34. As the containers 24 are inserted into the sockets, they are also snapped into cooling fins 28. When fully inserted into sockets 34, the rupturable membranes over the container openings have been punctured and syrup can flow by gravity into the associated valving mechanism. The valving mechanisms are also connected to the carbonated water output line of carbonator tank CT. Therefore, when a selected one of push levers 22 are actuated, syrup and carbonated water become mixed in the associated nozzle 20, producing a post-mix beverage of a desired flavor.

Because of the heat transfer couplings between the front wall 36 of reservoir WR; plate 26; cooling fins 28; and containers 24, the syrup is maintained in a refrigerated condition. The carbonated water tank CT is also refrigerated by the water in reservoir WR. Therefore, a cold post-mix beverage is available on demand.

The snap fit between contianers 24 and cooling fins 28 provides good thermal coupling and increases the cooling efficiency, as compared to a loose-fitting arrangement. Furthermore, the cooling fins 28 help support containers 24 and preclude tilting thereof.

The refrigeration system of the present invention is particularly effected in that syrup containers 24 are cooled by both conduction and convection. Fins 28 provide conductive cooling, and plate 26 convective cooling from the air which flows over its large surface and then to the syrup containers.

Figure 6:
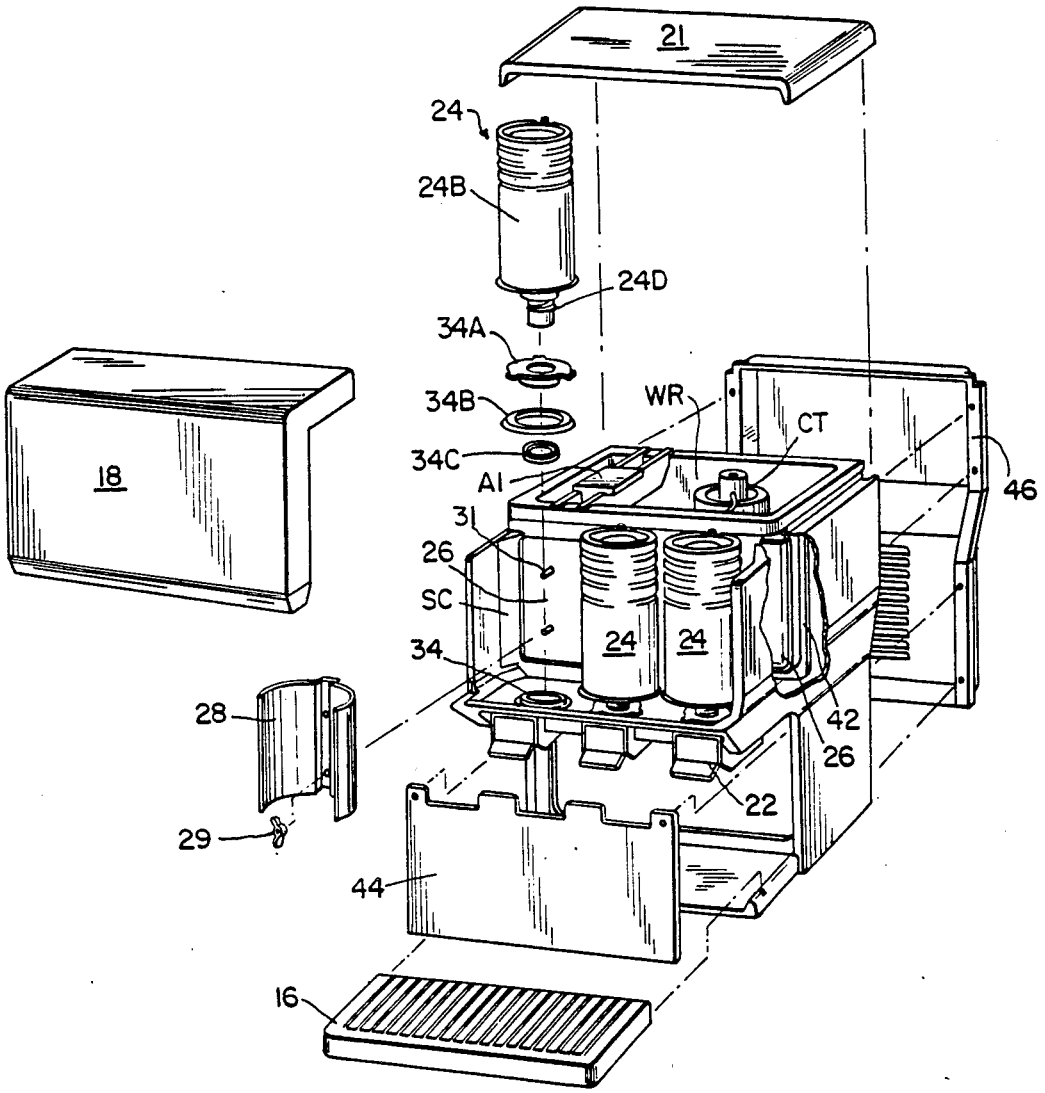
FIG. 6 is an exploded view of the beverage dispenser cabinet of the present invention inclusive of the refrigeration system embodiment of FIG. 5.
Figure 7:
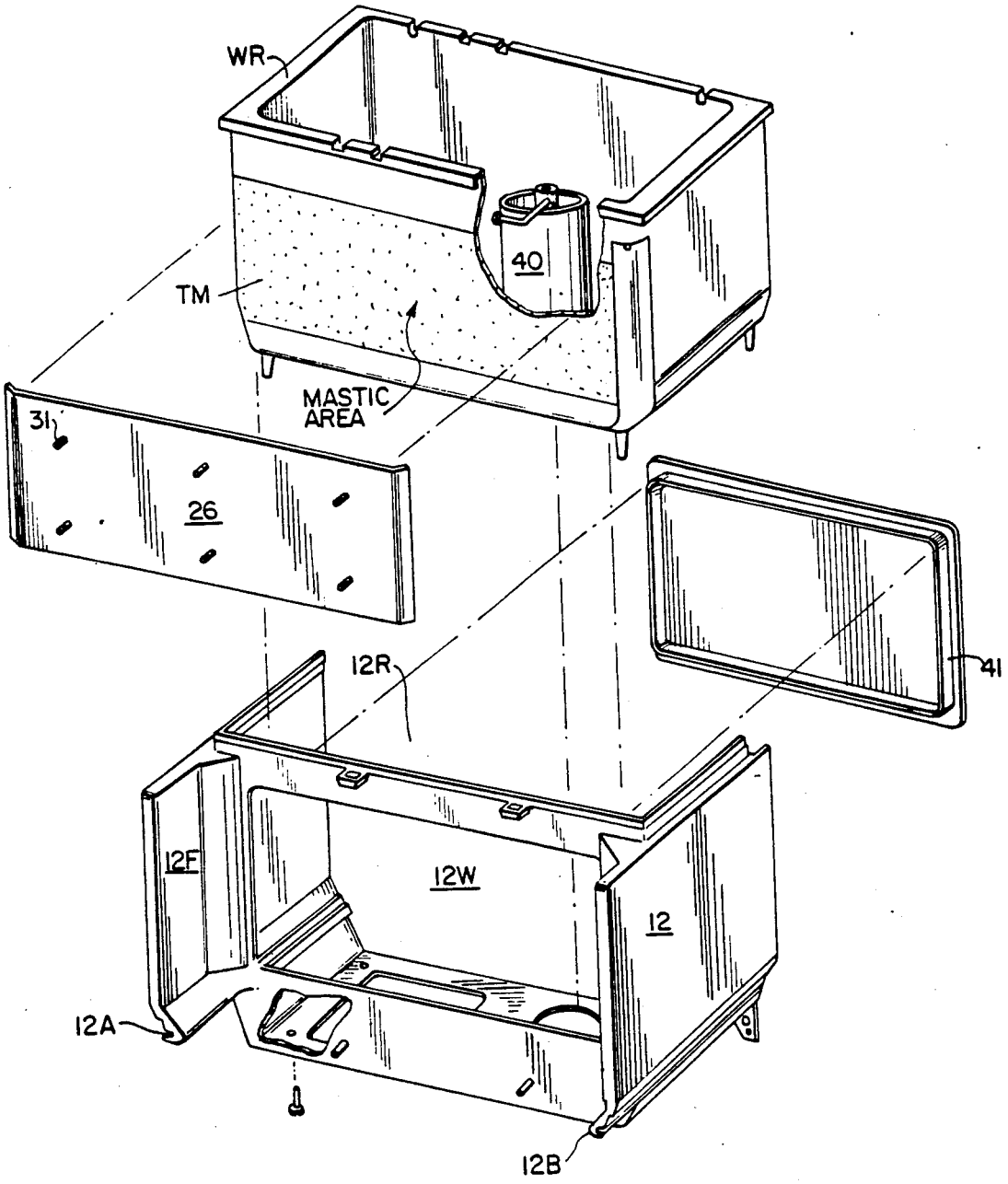
FIG. 7 is an exploded view of the upper housing assembly of the dispenser cabinet of FIG. 6.
Figure 8:
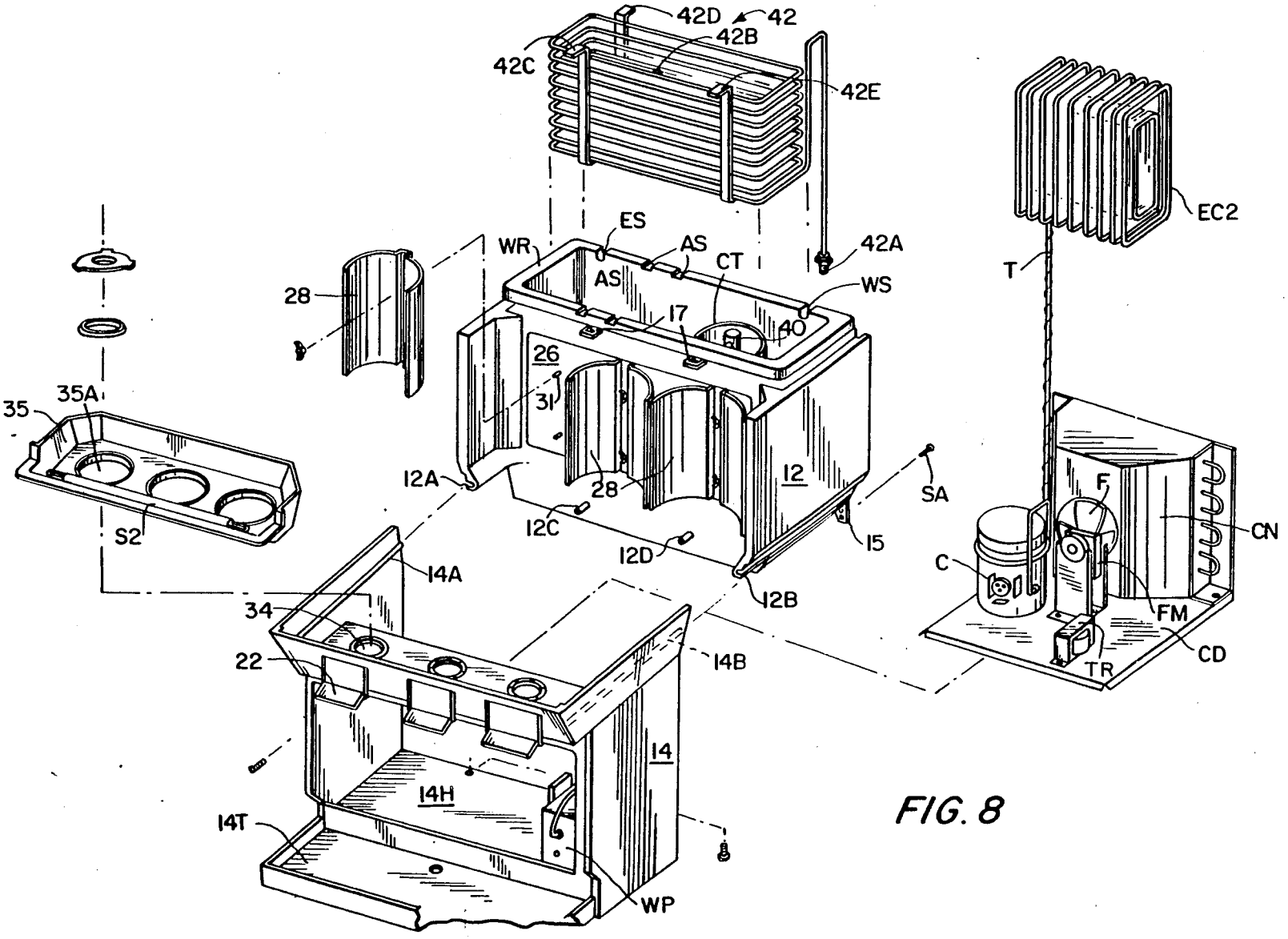
FIG. 8 is an exploded view illustrating how the upper housing assembly of FIG. 7 is attached to the lower housing assembly and how the refrigeration system of FIG. 5 is inserted into the beverage dispenser cabinet.

Another embodiment of a refrigeration system suitable for use with the dispenser of the present invention is illustrated in FIGS. 5 to 9. In this embodiment, the water in reservoir WR is non-potable, rather than potable, as in the first embodiment. That is, water reservoir WR is merely filled with water used as a cooling fluid surrounding the carbonator tank CT and cooling plate 26. The potable water to be carbonated in this embodiment is introduced through a water coil 42 disposed about the perimeter of the water reservoir WR. The details of the water coil 42 are illustrated in FIG. 8, to be described further hereinafter. One end of the water coil 42 is connected to a high pressure water pump WP which may be connected to a commercial water supply or other suitable source. The output end of coil 42 is connected to an input coupling 40 on the top of carbonator tank CT. Accordingly, the potable water entering carbonator tank 40 through the top thereof is already chilled when it enters the carbonator tank CT, which, combined with its high pressure, enhances its ability to rapidly absorb $CO_2$ gas. As illustrated in FIG. 8, the entire water coil assembly 42 may be easily lifted out of water reservoir WR for repair.

In this embodiment of the refrigeration system of FIGS. 5 to 9, the evaporator coil includes exposed coils of copper tubing EC2 since the water in which it is immersed is non-potable. This differs from the embodiment of FIG. 3 in which the evaporator coil is enclosed within a housing to isolate it from potable water in the reservoir. The elimination of the housing around the evaporator coil improves the cooling efficiency thereof with respect to the water within the reservoir WR.

Figure 5:
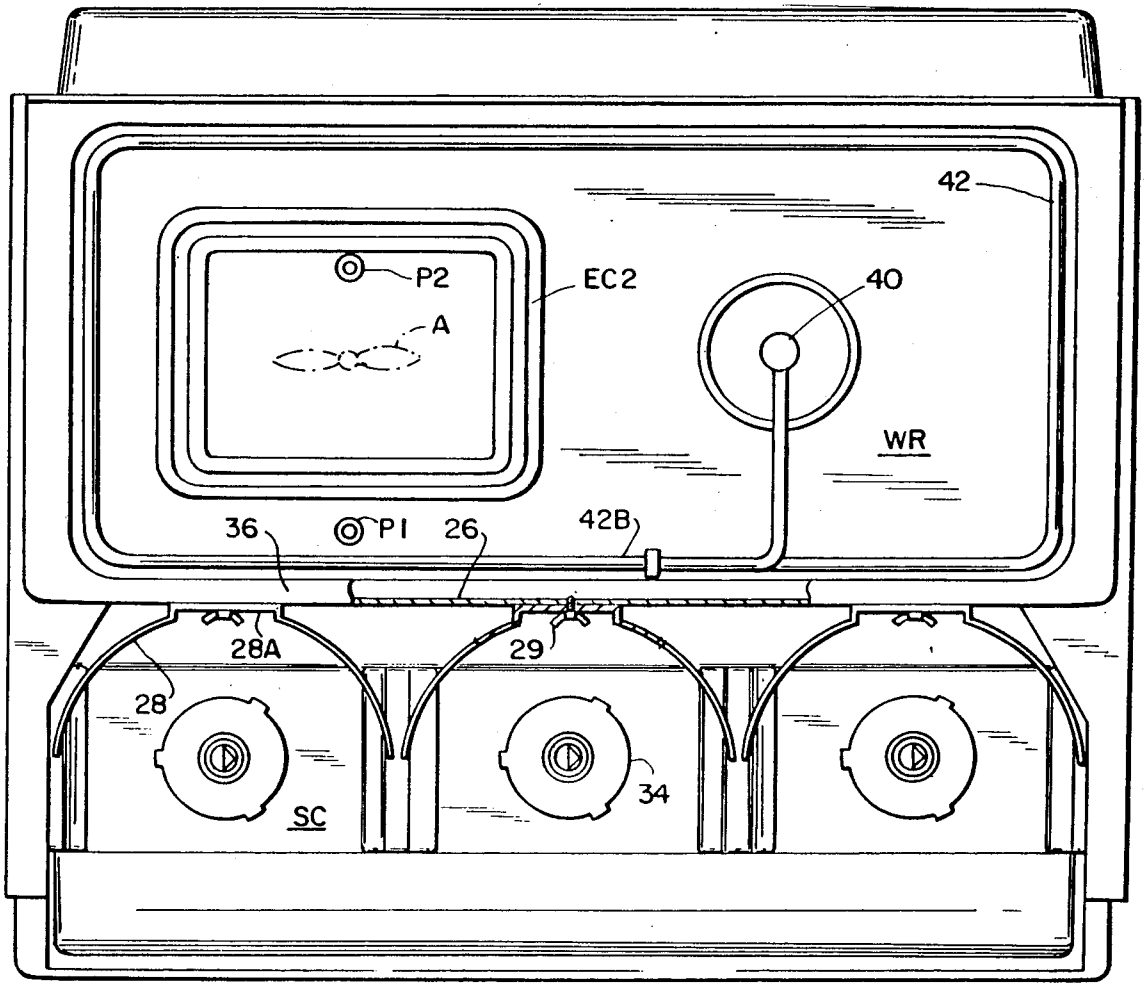
FIG. 5 is a top plan view similar to FIG. 3, illustrating an additional embodiment of the refrigeration system of the present invention.

As illustrated in FIG. 5 a pair of ice detection probes P1 and P2 are provided to detect icing conditions adjacent to the water coil 42, and the agitator impeller A, respectively. These ice-detection probes are connected in suitable control circuitry to turn the refrigeration compressor OFF when ice is detected adjacent to either the water coil 42 or the agitator impeller A. As will be described further hereinafter with reference to the agitator and ice probe assembly of FIG. 9, probes P1 and P2 are mounted on this agitator and ice probe assembly at predetermined spacings so that when the agitator assembly rests on the top of water reservoir WR, as illustrated in FIG. 6, the probes P1 and P2 are disposed at the proper locations adjacent to the water coils 42 and evaporator coil EC2, respectively.

The cabinet structure of the present invention and a method of assembling the component parts thereof is illustrated in detail in FIGS. 6 to 8. FIG. 6 is an exploded view of the entire cabinet assembly; FIG. 7 is an exploded view of the upper housing assembly; and FIG. 8 is an exploded view illustrating how the upper housing assembly is attached to the lower housing assembly and how the water coil 42 and the evaporator coil EC2 are inserted into the dispenser cabinet. In these Figures, like parts to those described hereinbefore with reference to FIGS. 1 to 4 are provided with like reference numerals.

Referring in detail to FIG. 7, the exploded view thereof illustrates how the upper housing assembly, generally designated 12, of the present invention is assembled. The upper housing assembly has a main frame having a rear compartment 12R and a front compartment 12F defining the syrup compartment SC. These two compartments are interconnected by a common wall through an opening or window 12W against which the cooling plate 26 is disposed. Cooling plate 26 is attached to the front wall of the water reservoir WR by a thermally conductive mastic TM. A gasket 41 is provided which fits into the window 12W. The water reservoir WR and cooling plate 26 attached thereto by mastic TM are then inserted into the rear compartment 12R of the upper housing assembly, and suitably secured into place by screws or the like. The reservoir WR is slightly smaller than the rear compartment 12R providing a space between the side and rear thereof. This space is filled with insulation, such as polystyrene foam or the like, which is injected into the space. Cooling fins 28 are then secured to the cooling plate 26 by means of wing nuts 20, which attach to screws 31 extending from cooling plate 36 (see FIG. 8). Assembly of the upper housing portion is then complete with the exception of the introduction of water coils 42 and the evaporator coils EC2.

This upper housing assembly 12 is then attached to the lower housing assembly 14 in the manner illustrated in the exploded view of FIG. 8. As illustrated in FIG. 8, the bottom edges of the sidewalls of main frame 12 have grooves 12A and 12B therein. These grooves are designed to ride on tracks 14A and 14B on the upstanding sidewalls of the lower housing assembly 14. However, before sliding the upper housing frame 12 with grooves 12A and 12B onto tracks 14A and 14B, syrup compartment tray 35 is placed in registry with socket openings 34 in the lower housing assembly 14. Upper housing assembly 12 is then slid into place on tracks 14A and 14B, and captures syrup compartment tray 35 in its proper location in the dispenser housing assembly. Threaded sockets 12C, 12D mate with screw holes (not shown) on the underside of the valve assembly housing to provide a stable connection between the upper and lower housing assemblies. Because of this construction and method of assembly which utilizes the grooves 12A, 12B and tracks 14A and 14B, the upper housing assembly 12, the lower housing assembly 14 and the syrup compartment tray 35 may all be held together by means of only a pair of screws, which pass through these holes into the threaded sockets.

Referring further to FIG. 8, it can be seen that the water coil assembly 42 is easily insertable into reservoir WR through the top opening thereof. The water inlet 42A to the coil is provided in a section of tubing which extends over the back wall of the reservoir WR through a slot WS, down to an appropriate position within the lower cabinet assembly for connection to the high pressure pump which may be coupled to a commercial water supply. The outlet end of the water coil 42B connects to a coupling 40 on the top of the carbonator tank CT, as described hereinbefore with reference to FIG. 5. Coil assembly 42 is also provided with three support brackets 42C, 42D and 42E, which rest on the upper edge of the reservoir WR to support the coil assembly 42 therein, adjacent the peripheral sidewalls. The length and diameter of coil 42 are selected to match the demand of the dispenser which determines the degree of cooling required by coil 42.

Another unique feature of the present invention is the manner in which the mechanical refrigeration system of the dispenser of the present invention can be easily inserted into or removed from the cabinet assembly. As illustrated in FIG. 8, the mechanical refrigeration assembly is mounted on a compressor deck CD, which includes a compressor C, a condensor CN, a transformer TR, an electric fan motor FM and a fan blade F. Extending upwardly from the compressor deck is a flexible portion of the evaporator coil T, which supports a copper evaporator coil assembly EC2 with the aid of a removable support rack (not shown). To insert the compressor deck assembly CD and the evaporator EC2 thereof into the appropriate places within the lower cabinet assembly 14 and the water reservoir WR, respectively, the compressor deck CD is slid into place into the compartment 14H within the lower cabinet assembly. When this position is reached, the evaporator coil assembly EC2 will still be vertically supported by the removable support rack and section T in an upright position, as illustrated in FIG. 8, extending up and above the top edge of the water reservoir WR. The coil assembly EC2 is then twisted and bent downwardly until it reaches its proper position within the water reservoir WR, illustrated in FIG. 5. Section T is preferably copper and may be twisted and bent many times without fatigue or damage. The flexible tubing portion T becomes seated in slot ES in the top edge of reservoir WR. If repair to this evaporator EC2 becomes necessary, the aforementioned assembly steps are reversed. That is, coil EC2 is bent up and out of the reservoir WR, and the compressor deck CD is slid out of the back of the lower cabinet assembly 14. Accordingly, the mechanical refrigeration of the dispenser of the present invention is modular, and may be easily slid into and out of the dispenser cabinet assembly for ease of manufacture, maintenance and repair.

Figure 9:
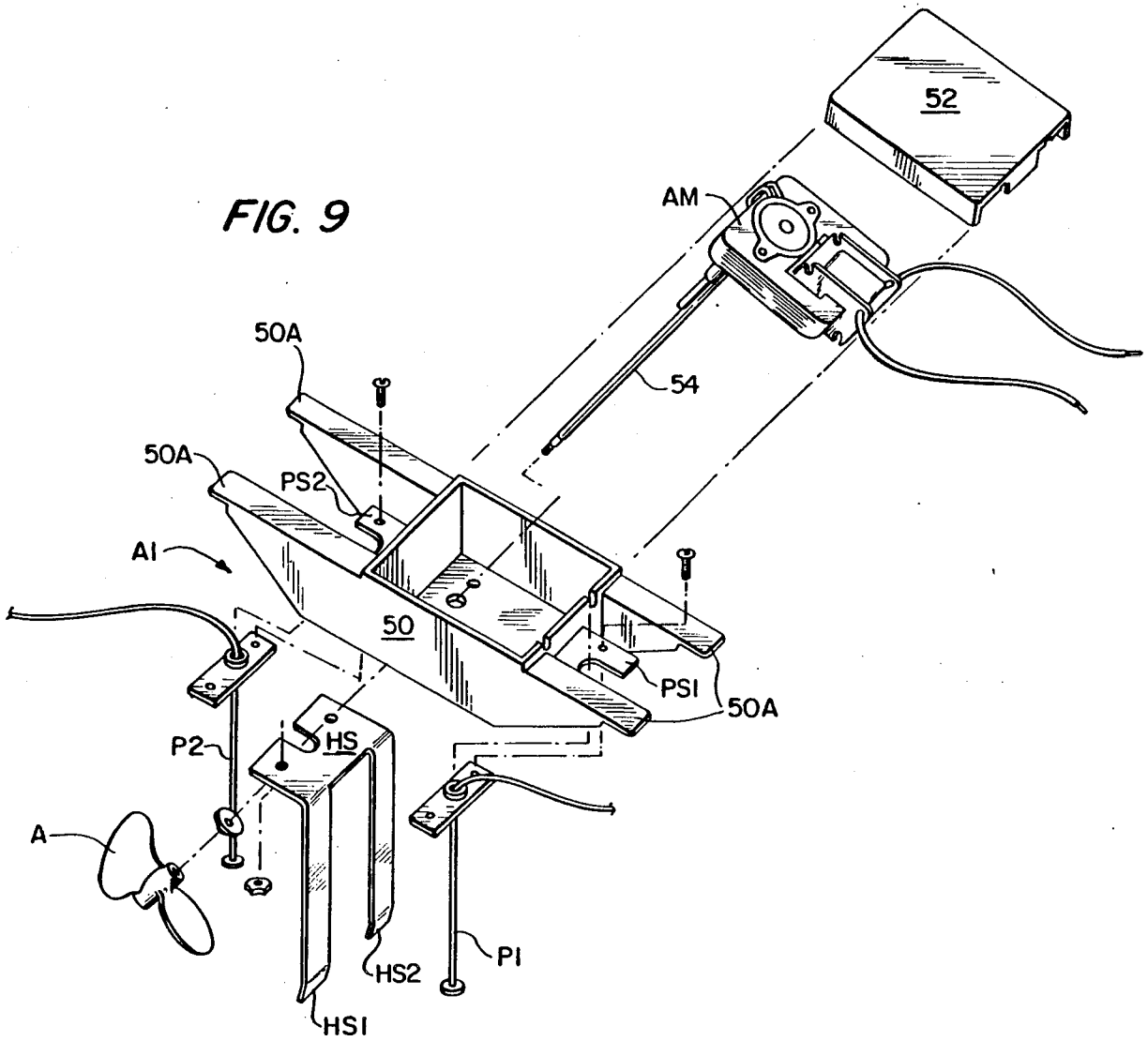
FIG. 9 is an exploded view of an agitator and probe assembly for use with the refrigeration system of FIG. 5.

Once the evaporator coil assembly EC2 and the associated compressor deck CD are in place, the agitator and probe assembly of FIG. 9 may be inserted into reservoir WR. The position of this agitator and probe assembly A1 is illustrated in FIG. 6. This assembly A1 has two pairs of arms to be described hereinafter, which support the assembly A1 in slots AS in the top edges of the walls of reservoir WR. Quick disconnect couplings are also provided for electrical power. Accordingly, the agitator and probe assembly is also easily insertable and removable from the cabinetry to facilitate ease of maintenance and repair.

The exploded view of FIG. 6 shows essentially how all of the component parts of the cabinet of the present invention, discussed hereinbefore with reference to FIGS. 7 and 8, fit together into a unitary cabinet structure to form the beverage dispenser illustrated in FIG. 1. It can be seen from FIG. 6 that after the component parts of the cabinet assembly and the mechanical refrigeration system, described hereinbefore with reference to FIGS. 7 and 8, is assembled together, all other necessary mechanical equipment is inserted and the entire cabinet is completed by attaching front plate 44 to the lower housing assembly and rear plate 46 to the rear of both the upper and lower housing assemblies 12 and 14. Removable covers 18 and 21 are then set in place to cover the syrup compartment SC and the water reservoir WR, respectively.

Although not specifically shown, the removable cover 18 over the syrup compartment SC is provided with a pair of protrusions which fit into the apertures 17 in a pair of tabs at the rear of the syrup compartment SC, as illustrated in FIG. 8.

FIG. 6 also illustrates in detail the components of a typical syrup socket 34, which include a syrup seal 34C, a syrup liner seal 34B, and a seal retainer 34A. These elements fit within apertures 35A of the syrup tray 35 and are operatively associated with the necks 24D of the syrup containers 24 in a manner described hereinbefore. The syrup tray 35 in this embodiment of the present invention is provided with an upstanding front rib S2, rather than the plurality of supports S illustrated in the embodiment of FIG. 2. This rib S2 helps support the containers 24 in an upright, stable condition in a similar manner to the supports S. The agitator and probe assembly of the present invention is illustrated in detail in the exploded view of FIG. 9, and is generally indicated A1. This assembly includes a main housing 50 having two pairs of support arms 50A which fit into grooves or slots AS in the top of the water reservoir WR illustrated in FIG. 8. The main housing portion also has a pair of probe support brackets PS1 and PS2 for supporting ice-detecting probes P1 and P2, respectively. Mounted within a central compartment of housing 50 is an agitator motor AM which is coupled through an impeller shaft 54 to an impeller A, which extends down into the water within reservoir WR in its final operative position. Also depending downwardly from housing 50 is a heat sink HS with a pair of arms HS1 and HS2. The heat sink HS is provided to dissipate the heat generated by the agitator motor AM into the non-potable water within the reservoir WR. A cover 52 is also provided to fit over top of the agitator motor and secure the same within the housing 50. As described hereinbefore, this agitator and probe assembly rests on the top of the water reservoir WR, and the impeller A, probes P1, P2 and heat sink arms HS1, HS2 extend into the water in the reservoir WR, arms HS1, HS2 extend to positions contiguous to or touching evaporator coil EC2 to maximize heat dissipation. The probes P1 and P2 are mounted on this assembly at a predetermined spacing so that they will be properly positioned within reservoir WR adjacent to the water coil 42 and agitator impeller A, respectively, as illustrated in FIG. 5.

It should be understood that the system described herein may be modified, as would occur to one of ordinary skill in the art without departing from the spirit and scope of the present invention.

What is claimed is:

1. In a refrigeration system for a post-mix beverage dispenser including a water reservoir with a top access opening therein, a water coil disposed within said water reservoir through which potable water to be mixed with flavor concentrate to form said post-mix beverage flows, an evaporator coil within said water reservoir to cool the water therein, and an agitator assembly for circulating the water in the water reservoir, an improvement in said agitator assembly comprising:

(a) a housing for supporting an agitator motor;

(b) support means extending from said housing for engagement with top edges of said water reservoir surrounding said top access opening;

(c) an impeller shaft extending from said motor into the water reservoir;

(d) an impeller on said shaft within the water reservoir;

(e) heat sink means coupling said agitator motor to the water in said water reservoir to dissipate heat in said motor into said water, said heat sink including a metal bracket coupled to said motor having a pair of fingers extending therefrom into said water on opposite sides of said impeller shaft to points adjacent said impeller and contiguous to said evaporator coil;

(f) first ice probe means for detecting the formation of ice adjacent to said water coil, said first ice probe means being mounted on said support means and extending downwardly into said water to positions adjacent said water coil; and (g) second ice probe means for detecting the formation of ice adjacent to said impeller, said second ice probe means being mounted on said support means a predetermined distance from said first ice probe means and extending downwardly into said water to positions adjacent said impeller.

* * * * *